US010472905B2

(12) United States Patent
Smith et al.

(10) Patent No.: US 10,472,905 B2
(45) Date of Patent: Nov. 12, 2019

(54) POWER TONG

(71) Applicant: Frank's International, LLC, Houston, TX (US)

(72) Inventors: Logan Smith, Lafayette, LA (US); Brian Begnaud, Lafayette, LA (US); Kirkrai Yuvamitra, Broussard, LA (US); Scott Arceneaux, Rayne, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 237 days.

(21) Appl. No.: 15/451,510

(22) Filed: Mar. 7, 2017

(65) Prior Publication Data

US 2018/0258718 A1 Sep. 13, 2018

(51) Int. Cl.
*E21B 19/16* (2006.01)
*E21B 17/042* (2006.01)

(52) U.S. Cl.
CPC ..... *E21B 19/161* (2013.01); *E21B 17/042* (2013.01); *E21B 19/164* (2013.01)

(58) Field of Classification Search
CPC ..... E21B 19/164; E21B 19/161; E21B 17/042
See application file for complete search history.

(56) References Cited

U.S. PATENT DOCUMENTS

| | | | |
|---|---|---|---|
| 3,147,652 | A | 9/1964 | George |
| 5,435,213 | A | 7/1995 | Buck |
| 5,669,653 | A | 9/1997 | Penisson |
| 6,223,629 | B1 | 5/2001 | Bangert |
| 6,237,445 | B1 | 5/2001 | Wesch, Jr. |
| 6,330,911 | B1 | 12/2001 | Allen et al. |
| 7,255,025 | B2 | 8/2007 | Dagenais et al. |
| 8,453,541 | B2 | 6/2013 | Dagenais et al. |
| 2003/0177870 | A1 | 9/2003 | Neves et al. |
| 2009/0272233 | A1 | 11/2009 | Musemeche |
| 2010/0083796 | A1 | 4/2010 | Nelson |

FOREIGN PATENT DOCUMENTS

| | | | |
|---|---|---|---|
| WO | 2004079148 | A2 | 9/2004 |

OTHER PUBLICATIONS

Jin Ho Kim (Authorized Officer), International Search Report and Written Opinion dated Nov. 23, 2017, PCT Application No. PCT/US2017/021032, filed Mar. 7, 2017, pp. 1-16.

*Primary Examiner* — Yong-Suk Ro
(74) *Attorney, Agent, or Firm* — MH2 Technology Law Group LLP

(57) ABSTRACT

A tong and method, in which the tong includes a first plate, and a gear that is rotatable relative to the first plate. The gear defines a slot laterally therethrough. An inner surface of the gear includes at least three cam surface. The tong also includes at least three jaws coupled to the first plate such that the at least three jaws are radially movable with respect to the first plate and are prevented from circumferential movement with respect thereto. The at least three jaws are engageable with the at least three cam surfaces such that rotation of the gear relative to the first plate causes the at least three jaws to move in a radial direction between an extended position and a retracted position.

19 Claims, 10 Drawing Sheets

POWER TONG

BACKGROUND

In the oil and gas industry, tongs are typically used to grip tubular members for connecting and disconnecting two tubular members. More particularly, a first type of tong (i.e., a power tong) rotates a first threaded tubular member, while a second type of tong (i.e., a backup tong) secures a second threaded tubular member against rotation. A single wellbore can have tubular members of varying diameters introduced therein. As the diameter increases, the torque required to achieve satisfactory makeup of a threaded connection may also increase. To achieve high make-up/break-out torque, the tong may use a plurality of jaws, which are fitted with dies, to provide adequate radial gripping force while avoiding deformation of the tubular member. The gripping force may be distributed more evenly circumferentially around the tubular member by increasing the number of jaws around the tubular member.

Conventional power tongs come in different types. One type includes a simple slotted rotary gear and retractable jaws that move radially by rotating the gear. Typically, this type has a limited range of torque due to a limited number of jaws in the tong. A second type includes a simple slotted rotary gear and pivoting jaws. The tubular members gripped by the tong can vary in diameter (e.g., due to industry standard tolerances even between tubular members that are nominally the same diameter). This can result in the pivoting jaws gripping the tubular member in a slightly eccentric position, which can result in uneven loading and potentially deformation of the tubular member, especially in high-torque applications. A third type of power tong includes a rotary gear and retractable jaws that move radially by rotating the gear. The gear includes a first rotary gear segment in a body of the power tong, and a second rotary gear segment in a door of the power tong. When the second rotary gear segment is aligned with the door and a slot (or "throat") in the body, the door can be opened, with the second rotary gear segment moving along with the door, thereby exposing the throat and allowing the tubular member to be inserted or removed laterally therethrough. This design ensures a generally uniform, centralized gripping of the tubular members. While this design is employed in the oilfield, having a segmented rotary gear complicates the operation of the tongs because it requires precisely positioning the rotary gear with respect to the tong body, so as to allow the door with the second rotary gear segment to swing open, away from the first rotary gear segment, and expose the slot for lateral movement of the tubular member.

SUMMARY

Embodiments of the disclosure may provide a tong that includes a cage plate assembly, and a gear that is rotatable relative to the cage plate assembly. The cage plate assembly includes a first portion and a second portion. Whenever a throat of the first portion is properly aligned with a throat of the rotary gear and the tong body, the door of the tong can then be opened. The second portion will move with the door when opened. Both the first and second portion of the cage plate assembly include an upper plate, a lower plate, and an interconnecting structure. The gear defines a slot laterally therethrough. An inner surface of the gear includes at least three sets of cam surfaces. The tong also includes at least three jaws coupled to the cage plate assembly such that the at least three jaws are radially movable with respect to the cage plate assembly and are prevented from circumferential movement with respect thereto. The at least three jaws are engageable with the at least three sets of cam surfaces such that rotation of the gear relative to the cage plate assembly causes the at least three jaws to move in a radial direction between a retracted position and an extended position.

Embodiments of the disclosure may also provide a rotary gear for the tong. The gear includes a substantially C-shaped member. An inner circumferential surface of the member includes one or more sets of cam surfaces. Each set of cam surfaces includes a first cam surface for make-up of tubular connections and a second cam surface for break-out of tubular connections. The first cam surface and the second cam surface are circumferentially-overlapping and positioned at different axial elevations with respect to a central longitudinal axis through the member.

Embodiments of the disclosure may also provide a method for making-up or breaking-out a tubular connection. The method includes opening a door of a tong to expose a throat formed in a gear of the tong, the tong body, and the cage plate assembly. All three throats must be aligned before opening the door. The method also includes introducing a tubular member laterally into the throat while the door is open, closing the door, and rotating the gear relative to the cage plate assembly. Rotating the gear causes the at least three jaws to engage the at least three sets of cam surfaces, respectively, defined on an inner surface of the gear, so as to move the at least three jaws radially inward and into contact with the tubular member. At least one of the three jaws is coupled to the second portion of the cage plate assembly and initially aligned with the slot. The slot is free from any gear segments. The method also includes rotating the tubular using the tong after the at least three jaws contact the tubular member.

The foregoing summary is intended merely to introduce a subset of the features more fully described of the following detailed description. Accordingly, this summary should not be considered limiting.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1A:
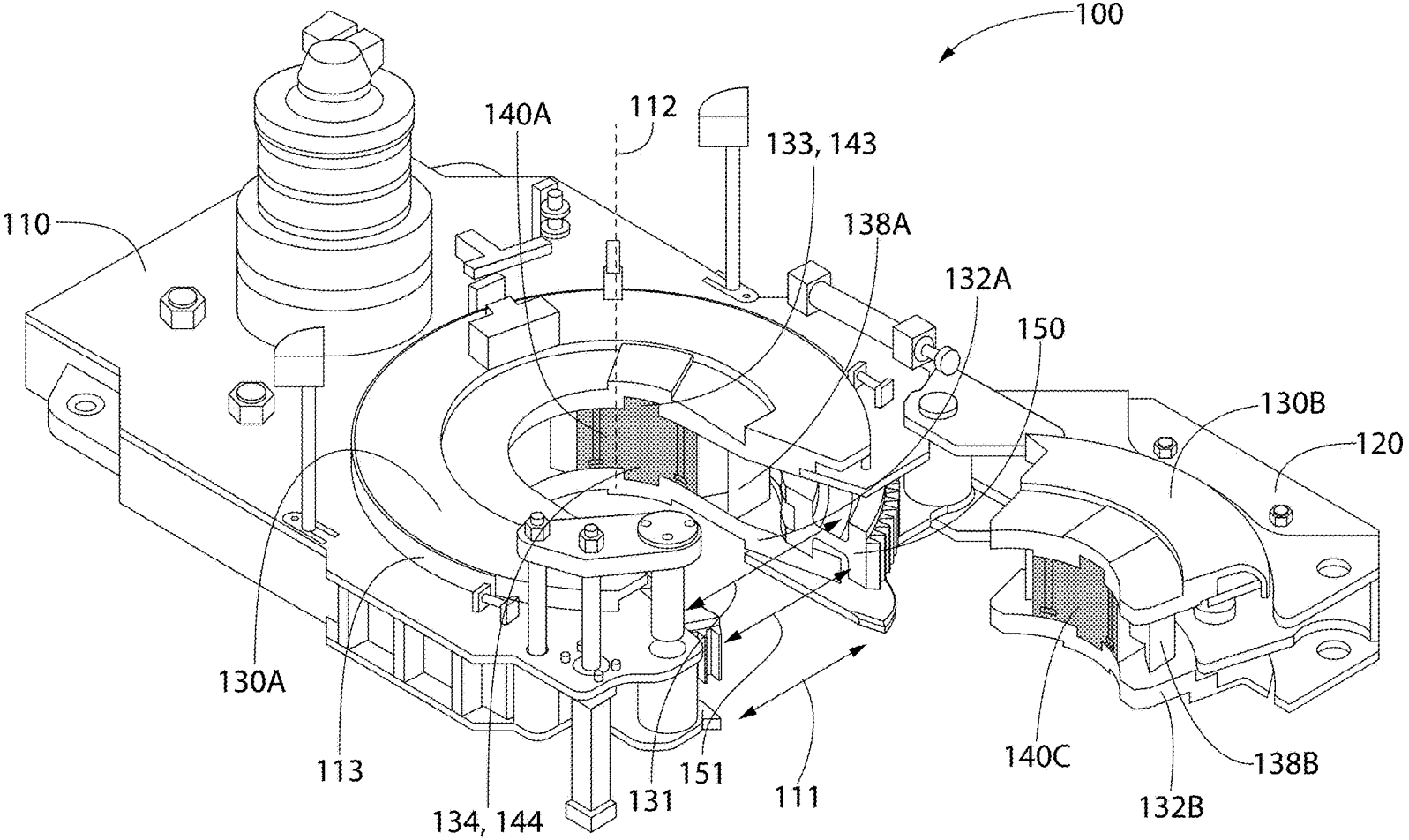
FIG. 1A illustrates a perspective view of a tong for gripping a tubular, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. The following description is merely a representative example of such teachings.

FIG. 1A illustrates a perspective view of a tong 100 for gripping a tubular member, according to an embodiment. The tong 100 may be a power tong. The tong 100 may include a body 110 and a door 120. The door 120 may be attached to the body 110 such that the door 120 may pivot or otherwise move between an open position (shown in FIG. 1) and a closed position, in which the door 120 can be latched or otherwise secured in place to the body 110.

Figure 1B:
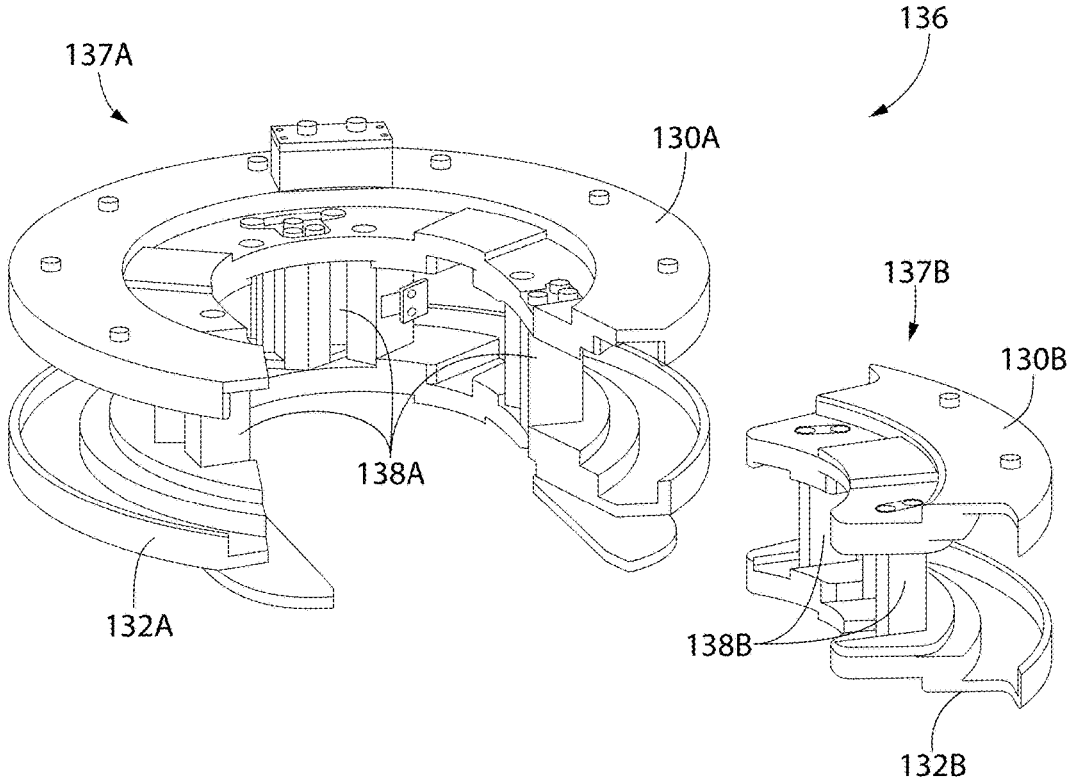
FIG. 1B illustrates a perspective view of a cage plate assembly of the tong with other components of the tong removed for clarity, according to an embodiment.

The tong 100 may include one or more cage plates, which are rotatable relative to the body 110, but may initially be constrained from rotation via a brake band 113 attached to the body 110. Two cage plates, which form a cage plate assembly 136, are shown in FIG. 1B. The cage plate assembly 136 includes a first portion 137A, including a portion of an upper plate 130A, a portion of a lower plate 132A, and an interconnecting structure 138A, and a second portion 137B, including a portion of an upper plate 130B, a portion of a lower plate 132B, and an interconnecting structure 138B. The first and second portions 137A, 137B of the cage plate assembly 136 are coaxially interfaced with the body 110 via guide rollers. Accordingly, the second portion 137B of the cage plate assembly 136 is configured to fit within a gap formed in the first portion 137A when the door 120 is closed. One or more radial slots 133 may be formed in the lower surface of the upper cage plate 130A, 130B, and one or more radial slots 134 may be formed in the upper surface of the lower cage plate 132A, 132B.

Returning back to FIG. 1A, the tong 100 may also include one or more jaws, for example, at least three jaws 140A, 140B, 140C. The jaw 140B is obstructed from view in FIG. 1, but shown, e.g., in FIG. 2A. The jaws 140A, 140B, 140C may be coupled to and/or positioned between the upper and lower cage plates 130, 132. For example, two of the jaws 140A, 140B may be coupled to and positioned between the first (e.g., body) portions 130A, 132A of the upper and lower cage plates, and one of the jaws 140C may be coupled to and positioned between the second (e.g., door) portions 130B, 132B of the upper and lower cage plates. The jaws 140A, 140B, 140C may also include ribs 143, 144 that are configured to fit within or otherwise engage the corresponding slots 133, 134 of the cage plates 130, 132. As shown, the ribs 143, 144 may be or include protrusions on the upper and/or lower surfaces of the jaws 140A, 140B, 140C. The engagement between the ribs 143, 144 and the slots 133, 134 may allow the jaws 140A, 140B, 140C to move radially-inward and radially-outward with respect to a central longitudinal axis 112 through the tong 100. However, the jaws 140A, 140B, 140C may remain rotationally-stationary (and/or rotated together) with respect to the cage plates 130, 132. In some embodiments, the slots 133, 134 and ribs 143, 144 may be shaped to provide a dovetail connection (e.g., undercut). It will be appreciated that a variety of structures may be employed to provide the slots 133, 134 and ribs 143, 144, whether integrally formed with the jaws 140A, 140B, 140C and/or the upper and lower cage plates 130, 132, or coupled therewith.

The tong 100 may also include a gear 150. The gear 150 may include a C-shaped member, e.g., a portion of a circular ring with a slot cut in it to allow admission of a tubular member laterally therein. For example, the gear 150 may be a solid, one-piece rotary gear with a circumferential slot (i.e., throat) 151. The tong 100 may not include a separate gear segment, as in some tongs, thus leaving the door 120 free from any part of the gear 150 or separate segment of gear, when the door 120 is hinged open and closed. As such, no part of the gear 150 may move with the door 120 in some embodiments. Further, the slot 151 may be considered an "open throat," since it is not filled with a gear segment. The gear 150 may be positioned axially-between the cage plates 130, 132 of the body 110. The gear 150 may also be positioned radially-outward from the jaws 140A, 140B, 140C. The gear 150 may be configured to rotate around the axis 112. Accordingly, the gear 150 may be configured to rotate to an open position. In the open position, the slot 151 in the gear 150 is aligned with a corresponding slot (i.e., throat) 111 in the body 110 and a slot 131 in the cage plate assembly 136 to allow a tubular member to be inserted laterally-therethrough or removed laterally-therefrom.

Figure 2A:
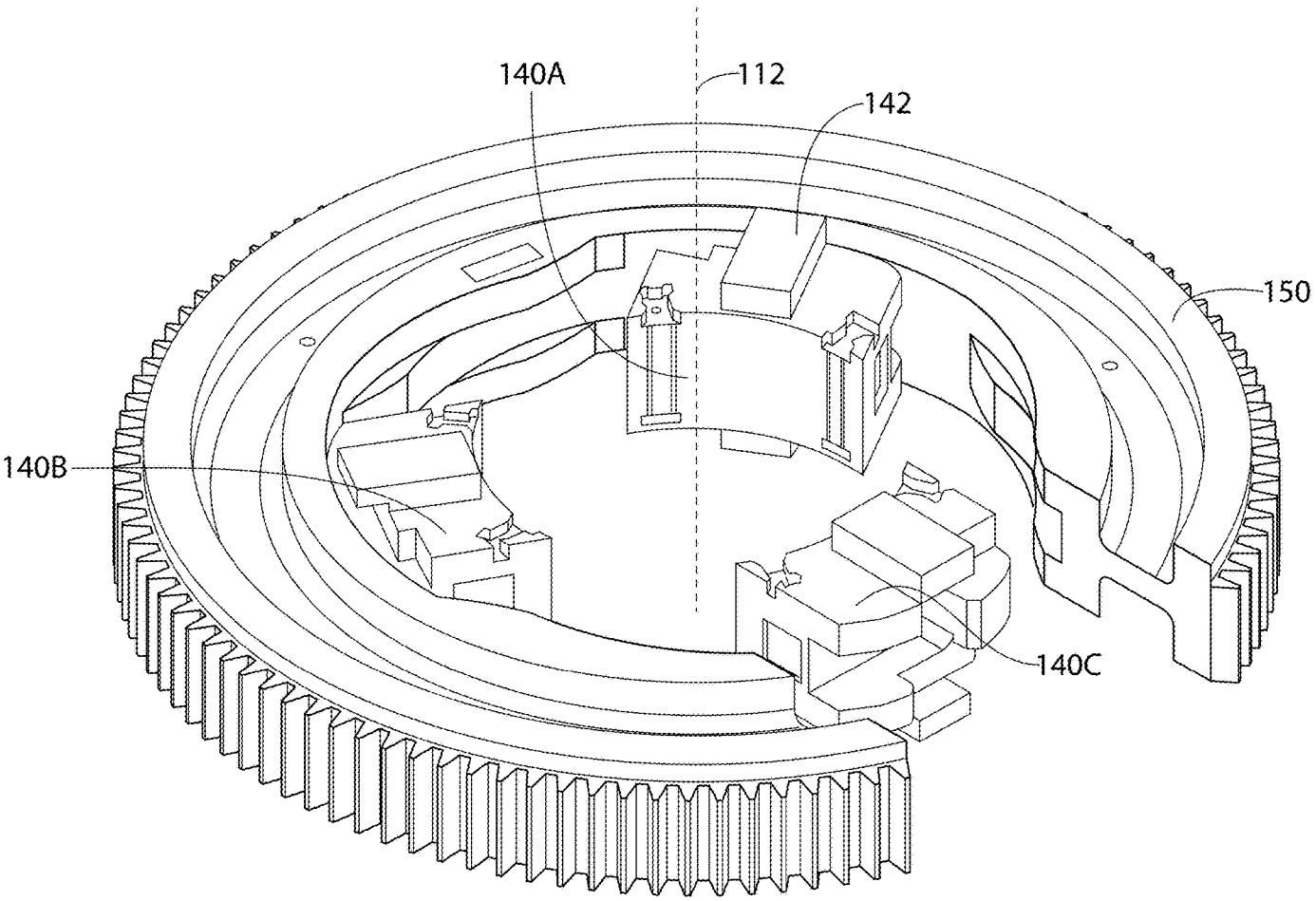
FIG. 2A illustrates a perspective view of three jaws positioned radially-inward from a gear, according to an embodiment.

FIG. 2A illustrates a perspective view of the gear 150 and the jaws 140A, 140B, 140C with the body 110, the door 120, and the plates 130, 132 omitted for clarity, according to an embodiment. When the door 120 is closed, the jaws 140A, 140B, 140C may be spaced evenly around the axis 112 (e.g., 120° apart from one another). This spacing may evenly distribute the forces applied to a tubular member, minimizing the likelihood of crushing or damaging the tubular member. As mentioned above, due to the engagement between the jaws 140A, 140B, 140C and the cage plates 130, 132, which prevents the jaws 140A, 140B, 140C from moving circumferentially with respect to the cage plates 130, 132, the jaws 140A, 140B, 140C may be configured to move radially in response to rotation of the gear 150 with respect to the cage plates 130, 132. More particularly, the jaws 140A, 140B, 140C are shown moved radially-outward with respect to the axis 112 (e.g., to release a tubular member 160). When the gear 150 rotates in either direction relative to the position of the jaws 140A, 140B, 140C (as shown in FIG. 2A), the jaws 140A, 140B, 140C are moved radially-inward from a retracted position to an extended position to grip the tubular member 160. Movement of the rotary gear 150 relative to the jaws 140A, 140B, 140C in a clockwise direction causes the jaws 140A, 140B, 140C to grip the tubular member 160 for make-up. Movement of the rotary gear 150 in a counter-clockwise direction causes the jaws 140A, 140B, 140C to grip the tubular member 160 for break-out.

As the jaws 140A, 140B, 140C move radially-inward toward the tubular member 160, the jaws 140A, 140B, 140C may make contact with the outer surface of the tubular member 160. Any slight deviation in the diameter of the tubular member 160 may cause the jaws 140A, 140B, 140C to move slightly radially-outward or slightly radially-inward, depending on whether the tubular member 160 is oversized or undersized.

Figure 2B:
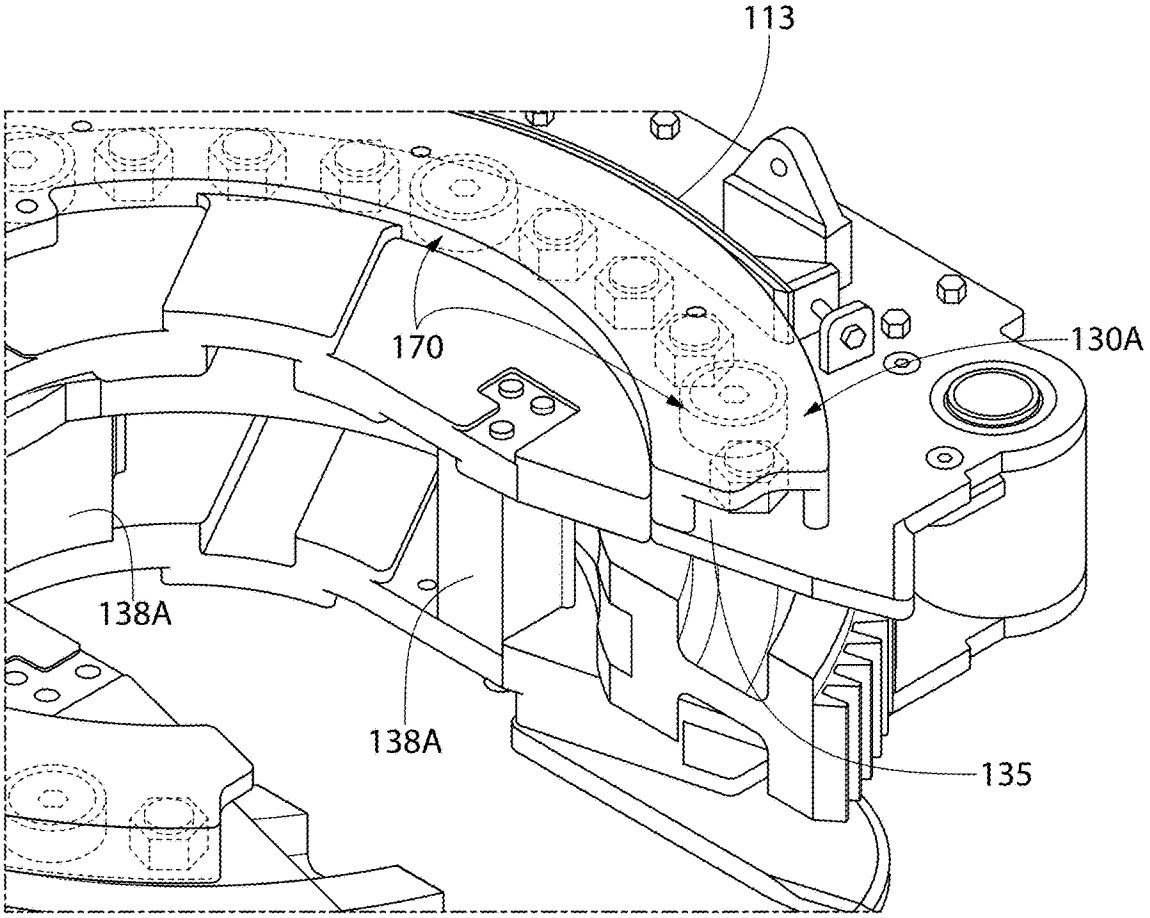
FIG. 2B illustrates a perspective view of one or more rollers interfacing with an upper plate, according to an embodiment.
Figure 2C:
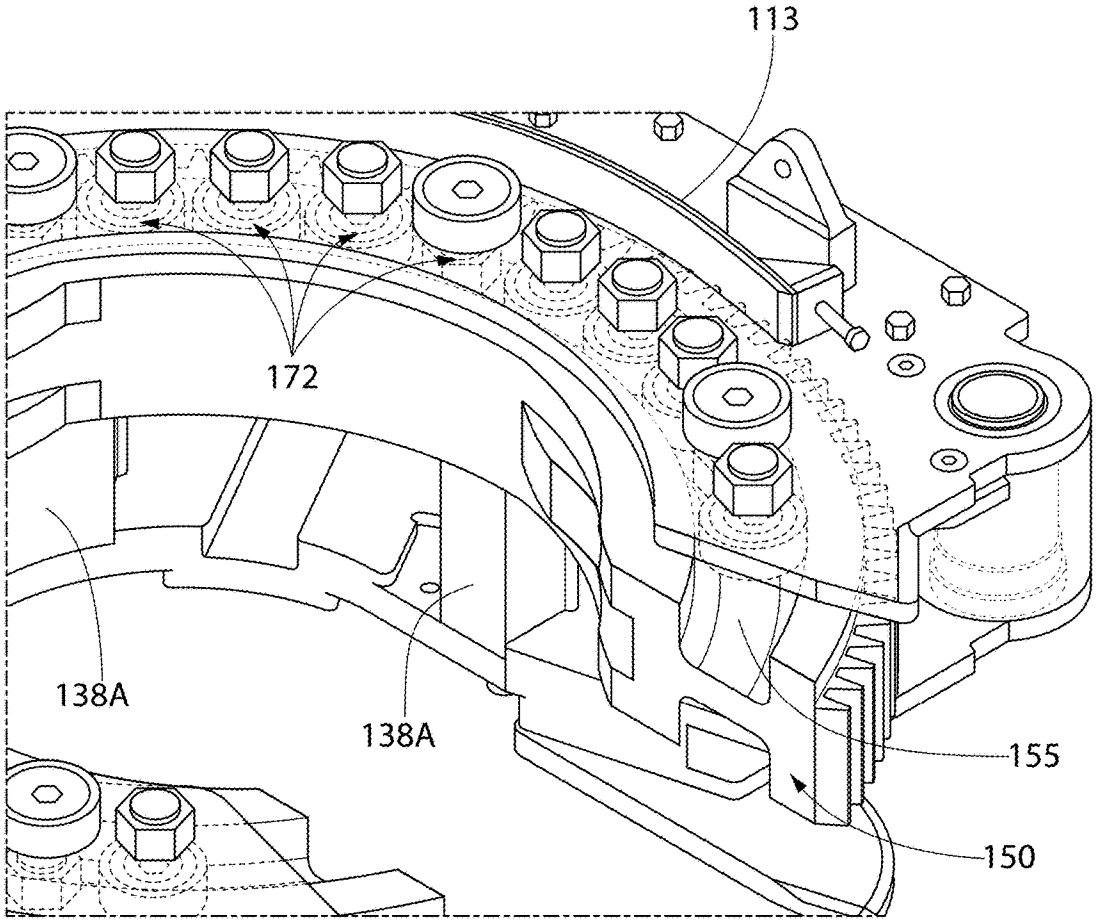
FIG. 2C illustrates a perspective view of one or more rollers interfacing with the gear, according to an embodiment.

FIG. 2B illustrates a perspective view of one or more rollers 170 interfacing with the upper cage plate 130, and FIG. 2C illustrates a perspective view of one or more rollers 172 interfacing with the gear 150, according to an embodiment. The combination of the rollers 170 and 172 allow the rotary gear 150 to rotate with respect to the upper and lower cage plates 130, 132, while transferring radial load from the rotary gear 150 to the cage plates 130, 132 and to the body 110.

After engagement of the tubular member, the upper and lower cage plates 130, 132, on both the body 110 and the door 120, may be configured to move in response to continued rotation of the gear 150, transmitted to the cage plates 130, 132 by the jaws 140A, 140B, 140C. Such rotational forces overcome the friction applied by the brake band 113, resulting in the cage plates 130, 132 and thus the jaws 140A, 140B, 140C rotating. In other words, when the jaws 140A, 140B, 140C are engaged with the tubular member 160 and can no longer move radially-inward, the jaws 140A, 140B, 140C begin rotating about the axis 112 together with the gear 150, and the engagement between the slots 133, 134 and ribs 143, 144 drives the cage plates 130, 132 around the axis 112 together with the jaws 140A, 140B, 140C. For example, the rollers 170 may be positioned within a groove 135 on the inside of the cage plates 130, 132. As the cage plates 130, 132 turn, the rollers 170 may force the cage plates 130, 132 to maintain the same axis of rotation as the gear 150. The gear 150 may also include a groove 155 that interfaces with rollers 172, which perform a similar function, maintaining the common rotational axis for the cage plates 130, 132 and the gear 150. This is shown in FIG. 2C.

Figure 3A:
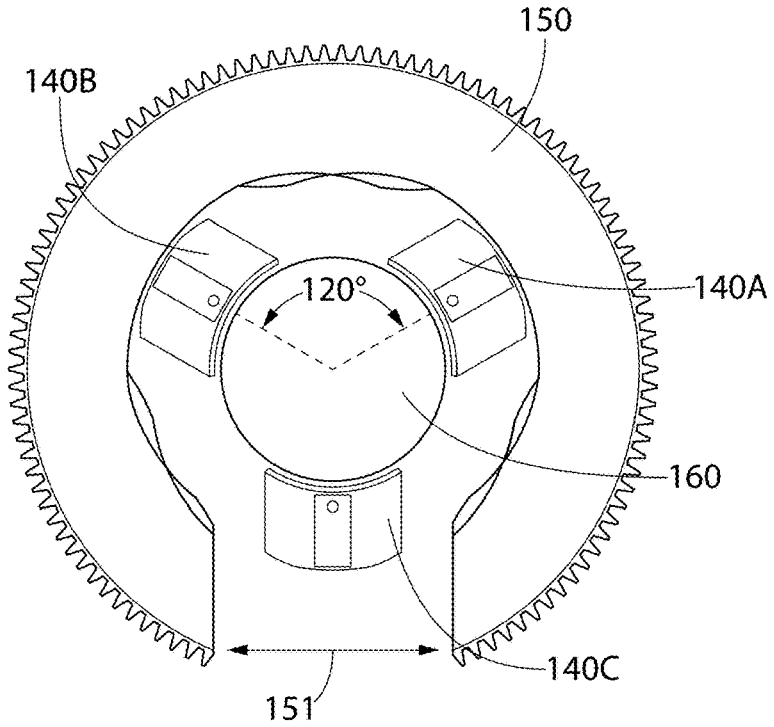
FIG. 3A illustrates a top view of the gear showing the jaws spaced radially-apart from a tubular member, according to an embodiment.
Figure 3B:
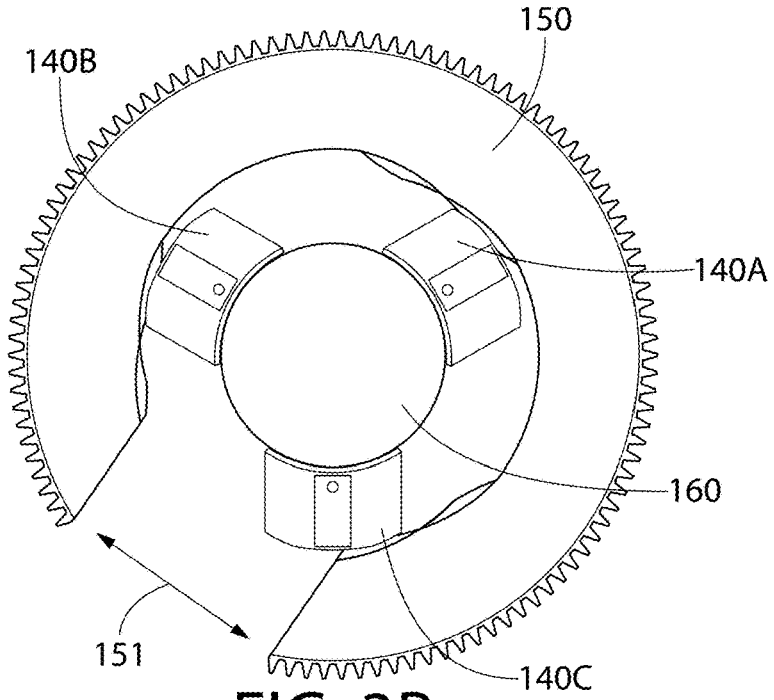
FIG. 3B illustrates a top view of the gear showing the jaws gripping the tubular member in a make-up direction, according to an embodiment.
Figure 3C:
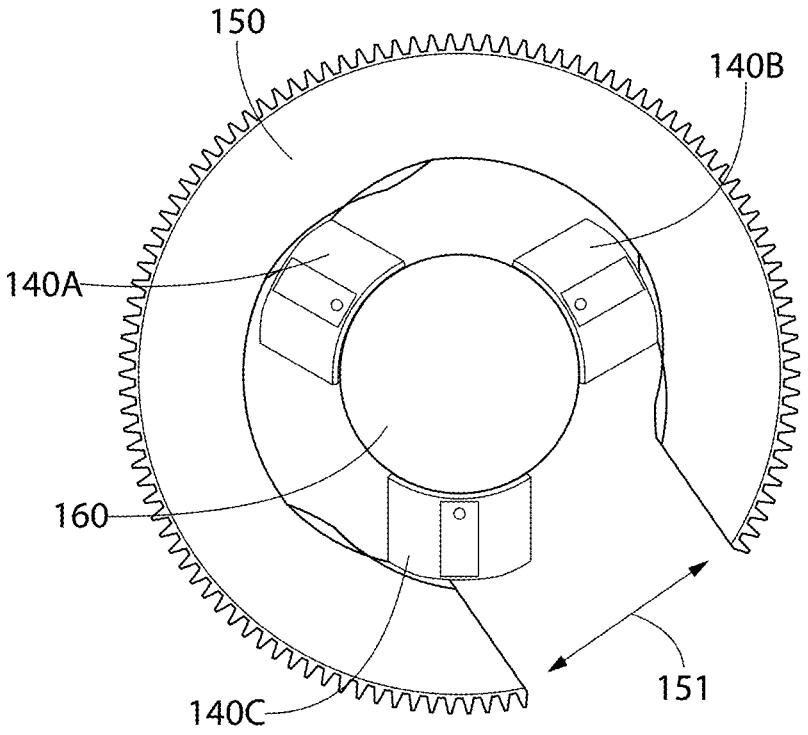
FIG. 3C illustrates a top view of the gear showing the jaws gripping the tubular member in a break-out direction, according to an embodiment.

FIG. 3A illustrates a top view of the gear 150 showing the jaws 140A, 140B, 140C spaced radially-apart from the tubular member 160, according to an embodiment. FIG. 3B illustrates a top view of the gear 150 showing the jaws 140A, 140B, 140C gripping the tubular member 160 in a make-up direction, according to an embodiment. FIG. 3C illustrates a top view of the gear 150 showing the jaws 140A, 140B, 140C gripping the tubular member 160 in a break-out direction, according to an embodiment.

Figure 4A:
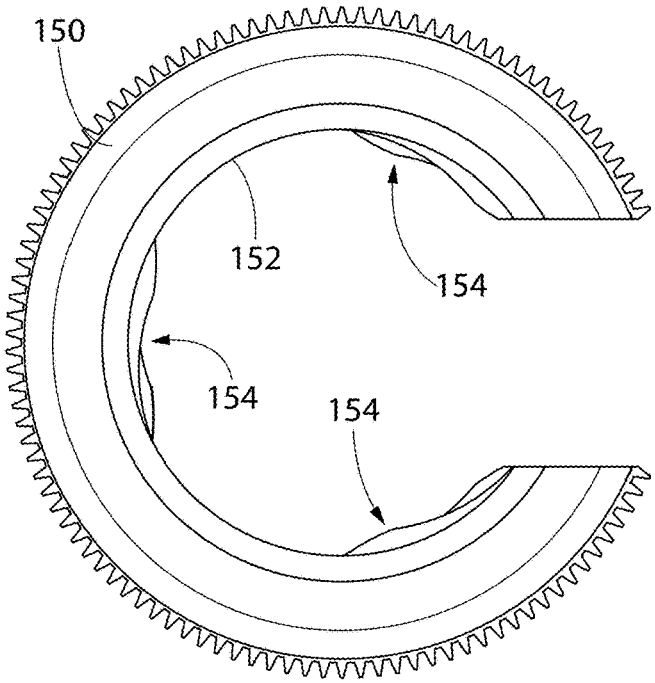
FIG. 4A illustrates a top view of the gear with the jaws removed for clarity, according to an embodiment.
Figure 4B:
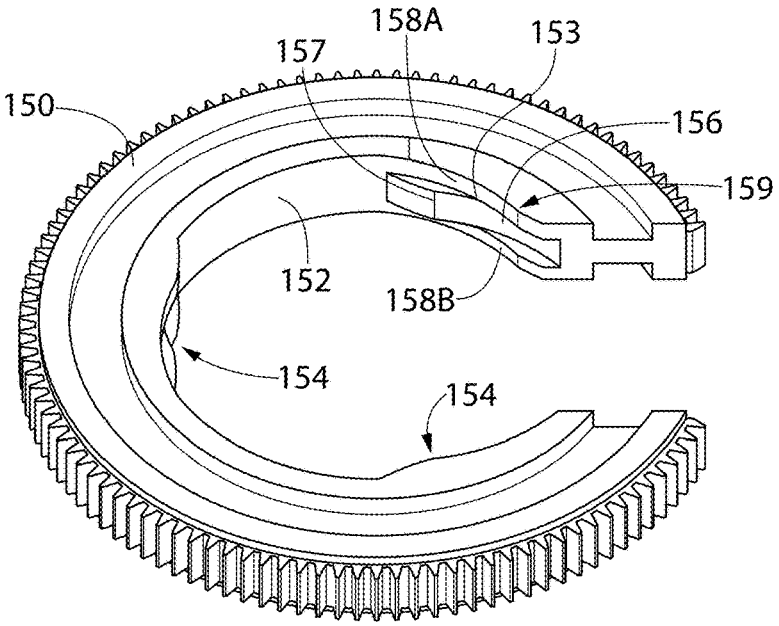
FIG. 4B illustrates a perspective view of the gear with the jaws removed for clarity, according to an embodiment.

FIGS. 4A and 4B illustrate a top view and a perspective view, respectively, of the gear 150 with the jaws 140A, 140B, 140C removed for clarity, according to an embodiment. An inner radial surface 152 of the gear 150 may include a set of cam surfaces 154 for each jaw 140A, 140B, 140C. Thus, the sets of cam surfaces 154 may be circumferentially-offset from one another at (e.g., substantially uniform) intervals around the gear 150. Each set of cam surfaces 154 may include a plurality of cam surfaces. More particularly, each set of cam surfaces 154 may include one or more first cam surfaces (one is shown: 156) for make-up of two tubular members and one or more second cam surfaces (two are shown: 158A, 158B) for break-out of two tubular members. As shown, the first cam surface 156 and the second cam surfaces 158A, 158B may be positioned at different elevations with respect to the axis 112. For example, the first cam surface 156 may be positioned axially-between the upper and lower second cam surfaces 158A, 158B.

The radial distance from the center of the gear 150 to the surface of the first cam surface 156 (with respect to the axis 112) may decrease proceeding in a first circumferential direction (e.g., counterclockwise) until it reaches an end point 157. The radial distance from the center of the gear 150 to the surface of the second cam surfaces 158A, 158B may decrease proceeding in a second circumferential direction (e.g., clockwise) until they reach an end point 159. The radial distance from the center of the gear 150 to the surface of the first cam surface 156 and the surface of the second cam surfaces 158A, 158B may be equal at a circumferential point 153. The first cam surface 156 and the second cam surfaces 158A, 158B may be circumferentially overlapping, but may not intersect axially. The radial distance from the center of the gear 150 to the surface of the first cam surface 156 may be greater than the radial distance to the surface of the second cam surfaces 158A, 158B (e.g., forming a slot) on a first circumferential side of the circumferential point 153. The radial distance from the center of the gear 150 to the surface of the first cam surface 156 may be less than the radial distance to the surface of the second cam surfaces 158A, 158B (e.g., forming a protrusion) on a second circumferential side of the circumferential point 153. This design may allow each jaw 140A, 140B, 140C to travel a larger radial distance toward and away from the tubular member 160, over a shorter circumferential distance compared to conventional designs to ensure that the jaws 140A, 140B, 140C will grip the tubular member 160. This reduction in circumferential travel to effect sufficient radial travel for the jaws 140A, 140B, 140C by providing such overlapping cam-surfaces allows for the use of three jaws that are substantially equally spaced apart in a single, C-shaped rotary gear 150, without a door-segment for the gear 150.

Figure 5:
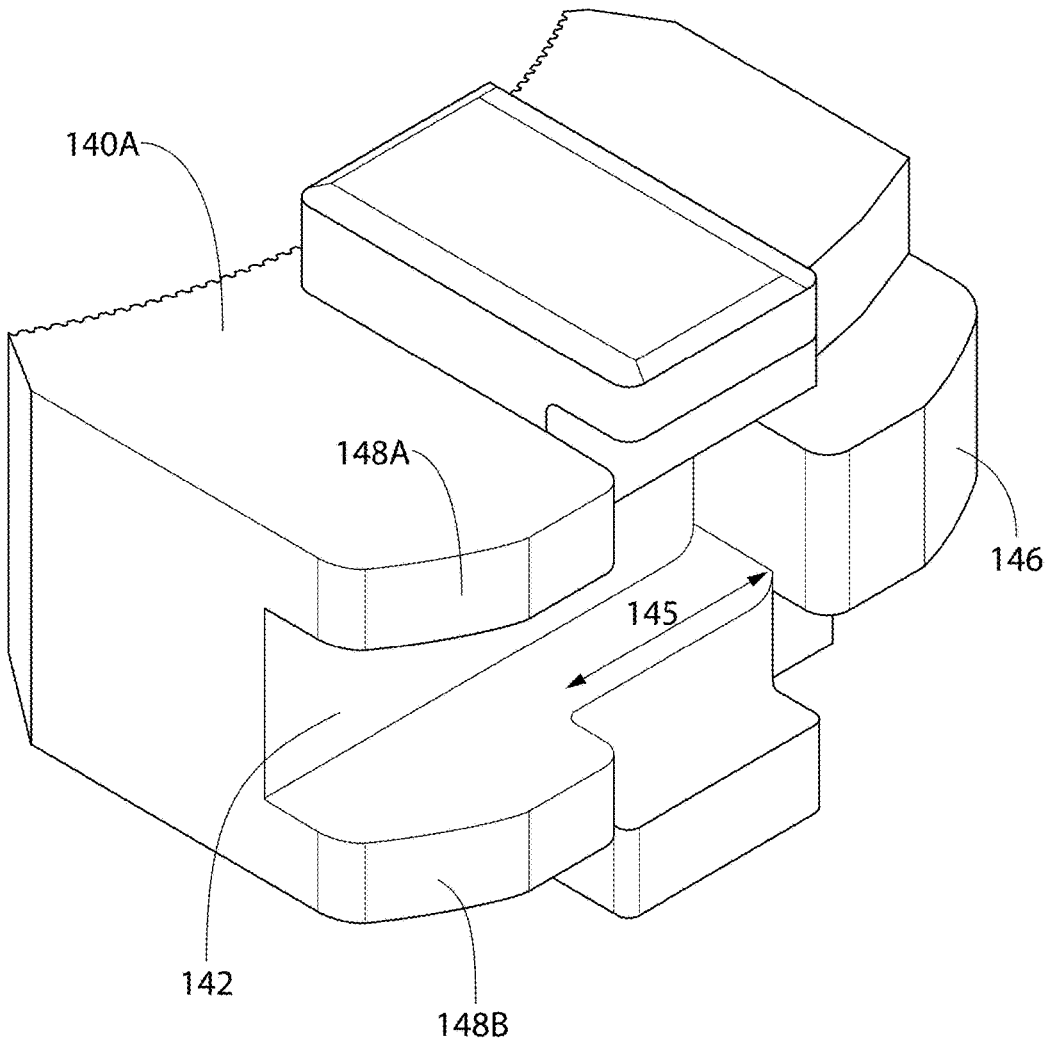
FIG. 5 illustrates a perspective view of an outer surface of one of the jaws, according to an embodiment.

FIG. 5 illustrates a perspective view of an outer radial surface 142 of one of the jaws 140A, according to an embodiment. The outer radial surface 142 of the jaw 140A may be configured to contact the inner radial surface 152 of the gear 150. The outer radial surface 142 of the jaw 140A may include a plurality of cam surfaces. More particularly, the outer radial surface 142 of the jaw 140A may include one or more first cam surfaces (one is shown: 146) for make-up and one or more second cam surfaces (two are shown: 148A, 148B) for break-out. The first cam surface 146 and the second cam surfaces 148A, 148B may be positioned at different axial elevations. As shown, the first cam surface 146 may be positioned axially-between upper and lower second cam surfaces 148A, 148B. In addition, a circumferential gap 145 may be present between the first cam surface 146 and the second cam surfaces 148A, 148B.

The radial distance from the gripping surface of the jaw to of the first cam surface 146 may decrease proceeding in a first circumferential direction (e.g., counterclockwise from the center of the jaw). The radial distance from the gripping surface of the jaw to the second cam surfaces 148A, 148B may decrease proceeding in a second circumferential direction (e.g., clockwise from the center of the jaw).

Figure 6:
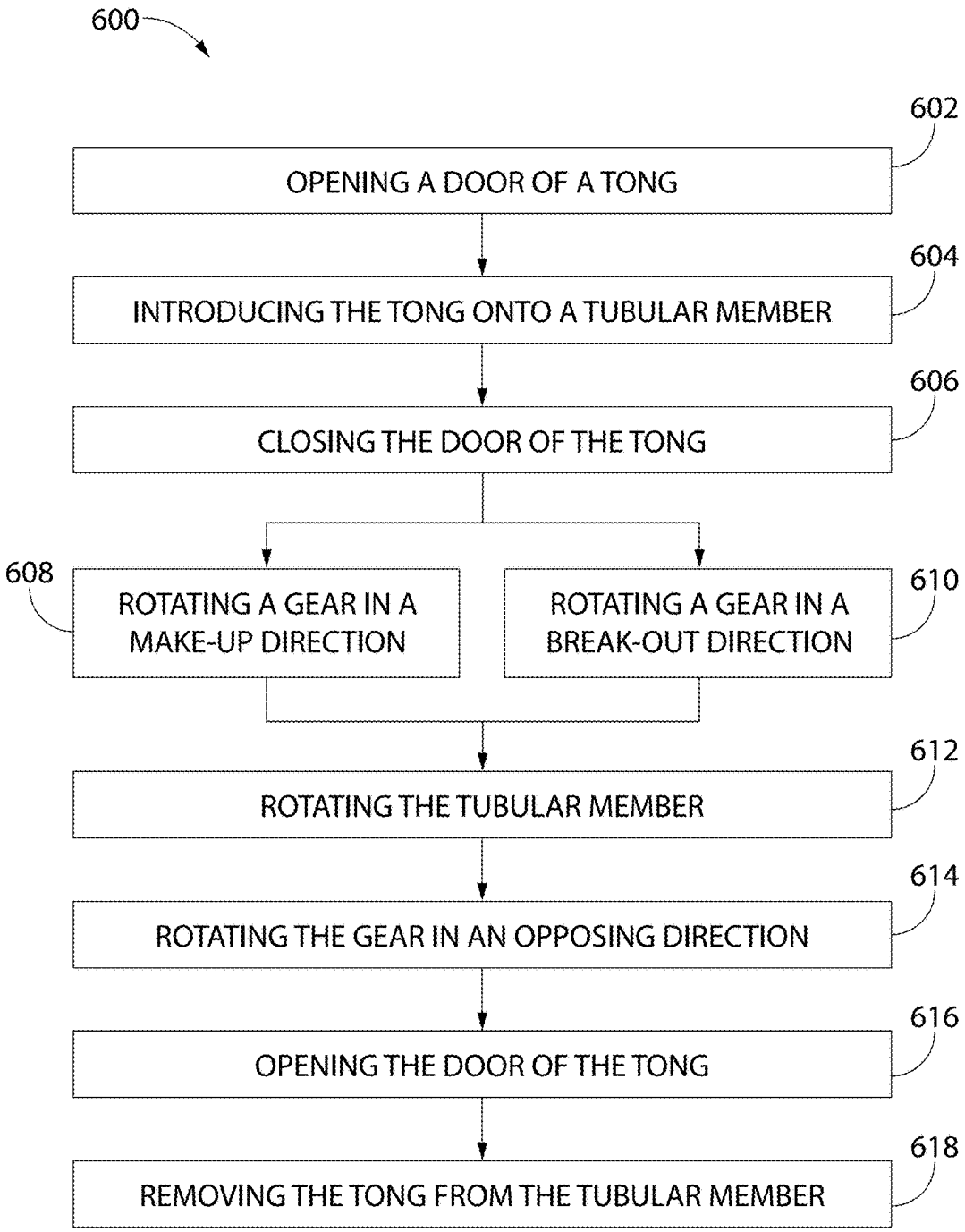
FIG. 6 illustrates a flowchart of a method for making-up or breaking-out a tubular connection, according to an embodiment.

FIG. 6 illustrates a flowchart of a method 600 for making-up or breaking-out a tubular connection (e.g., between two tubular members 160), according to an embodiment. The method 600 may include opening the door 120 of the tong 100, as at 602. The method 600 may then include introducing the tong 100 laterally-onto/around the tubular member 160 when the door 120 is open, as at 604. The slot 111 in the body 110 may be aligned with the slot 151 in the gear 150 (as well as the slot 131 in the first portion of the cage plate assembly 136) when the tong 100 is introduced laterally-onto/around the tubular member 160. The method 600 may also include closing the door 120 with the tubular member 160 positioned within the tong 100, as at 606.

For make-up, the method 600 may include rotating the gear 150 in a make-up direction (e.g., clockwise), as at 608. The gear 150 may be rotated by a hydraulic motor. In response to rotating in the make-up direction, the first cam surfaces 156 of the gear 150 may slide along the first cam surfaces 146 of the jaws 140A, 140B, 140C, causing the jaws 140A, 140B, 140C to move radially-inward and grip the outer surface of the tubular member 160. For break-out, the method 600 may include rotating the gear 150 in a break-out direction (e.g., counterclockwise), as at 610. In response to rotating in the break-out direction, the second cam surfaces 158A, 158B of the gear 150 may slide along the second cam surfaces 148A, 148B of the jaws 140A, 140B, 140C, causing the jaws 140A, 140B, 140C to move radially-inward and grip the outer surface of the tubular member 160. In some applications, connections may require more torque for break-out operations than make-up operations, and thus in some embodiments, the second (e.g., break-out) cam surfaces 158A, 158B may have a greater aggregate surface area than the first (e.g., make-up) cam surface 156.

After either 608 or 610, the method 600 may include rotating the tubular member 160 using the tongs 100, as at 612. Once the tubular member 160 is gripped by the jaws 140A, 140B, 140C, continued rotation of the gear 150 may cause the jaws 140A, 140B, 140C, and the tubular member 160 gripped by the jaws 140A, 140B, 140C, to rotate about the axis 112. As mentioned above, rotation of the jaws 140A, 140B, 140C may cause the cage plates 130, 132 to rotate about the axis 112 due to the engagement of the slots 133, 134 and the ribs 143, 144. For right-handed threaded connections, rotation of the tubular member 160 in the clockwise direction may lead to the make-up of the tubular member 160 with another tubular member, and rotation of the tubular member 160 in the counterclockwise direction may lead to the break-out of the tubular member 160 from another tubular member. For left-handed threaded connections, rotation of the tubular member 160 in the counterclockwise direction may lead to the make-up of the tubular member 160 with another tubular member, and rotation of the tubular member 160 in the clockwise direction may lead to the break-out of the tubular member 160 from another tubular member.

The method 600 may also include rotating the gear 150 in an opposing direction (e.g., counterclockwise after make-up or clockwise after break-out), as at 614. This may cause the jaws 140A, 140B, 140C to move radially-outward and release the tubular member 160. This may also cause the slot 151 in the gear 150 to once again align with the slot 111 in the body 110 (and the slot 131 in the cage plate assembly 136). The method 600 may also include opening the door 120, as at 616. The method 600 may also include removing the tong 100 laterally from the tubular assembly 160, as at 618.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A power tong, comprising:

a body defining a throat;

a cage plate assembly, wherein the cage plate assembly comprises a first portion that defines a gap that corresponds to the throat of the tong, and a second portion that fits in the gap of the first portion;

a gear that is rotatable relative to the cage plate assembly and the body, wherein the gear defines a slot laterally therethrough that is alignable with the throat so as to allow a tubular to be received therethrough, and wherein an inner surface of the gear comprises at least three sets of cam surfaces, wherein each set of cam surfaces comprises a first cam surface and a second cam surface, and wherein the first cam surface and the second cam surface are positioned at different axial elevations with respect to a central longitudinal axis through the gear; and at least three jaws coupled to the cage plate assembly such that the at least three jaws are radially movable with respect to the cage plate assembly and are prevented from circumferential movement with respect thereto, wherein the at least three jaws are engageable with the at least three sets of cam surfaces of the gear such that rotation of the gear relative to the cage plate assembly causes the at least three jaws to move in a radial direction between a retracted position and an extended position.

2. The tong of claim 1, wherein the at least three jaws are positioned at substantially equal intervals around a central rotational axis of the gear.

3. The tong of claim 1, wherein at least one of the at least three jaws is aligned with the throat of the tong when the at least three jaws are in the retracted position, and when no portion of the gear is positioned within the throat of the tong.

4. The tong of claim 1, further comprising:

a door that is coupled to the tong body and movable between an open position in which the door permits access to the tong throat, and a closed position in which the door blocks the tong throat, wherein at least one of the three jaws and the second portion of the cage plate assembly aligned with the throat of the tong is movable with the door between the open position and the closed position.

5. The tong of claim 1, wherein the cage plate assembly comprises a first portion and a second portion, wherein:

the first portion and the second portion each comprise an upper plate and a lower plate;

two of the at least three jaws are positioned axially-between the upper and lower plates of the first portion; and one of the at least three jaws is positioned axially-between the upper and lower plates of the second portion.

6. The tong of claim 5, further comprising an interconnecting member positioned axially-between the upper and lower plates.

7. The tong of claim 1, wherein the second cam surface of each of the at least three sets of cam surfaces comprises an upper second cam surface, and a lower second cam surface, and wherein the first cam surface is positioned at least partially axially-between the upper second cam surface and the lower second cam surface.

8. The tong of claim 7, wherein a radial distance from a center of the gear to the first cam surface decreases proceeding in a first circumferential direction, and wherein a radial distance from the center of the gear to the upper and lower second cam surfaces decreases proceeding in a second, opposing circumferential direction.

9. The tong of claim 7, wherein the upper and lower second cam surfaces have a greater aggregate surface area than the first cam surface.

10. The tong of claim 7, wherein an outer radial surface of a first of the at least three jaws comprises a first cam surface for the make-up of tubular connections and a second cam surface for the break-out of tubular connections, and wherein the first and second cam surfaces of the first jaw are positioned at different axial elevations with respect to a central longitudinal axis of the tong.

11. The tong of claim 10, wherein the second cam surface of the first jaw comprises an upper second cam surface and a lower second cam surface, and wherein the first cam surface of the first jaw is positioned axially-between the upper and lower second cam surfaces of the first jaw.

12. A gear for a tong, comprising:

a substantially C-shaped member, wherein an inner radial surface of the member comprises one or more sets of cam surfaces, wherein each set of cam surfaces comprises a first cam surface for make-up of tubular connections and a second cam surface for break-out of tubular connections, and wherein the first cam surface and the second cam surface are positioned at different axial elevations with respect to a central longitudinal axis through the member.

13. The gear of claim 12, wherein the inner radial surface of the member comprises three sets of cam surfaces positioned at substantially equal intervals around a central rotational axis of the gear.

14. The gear of claim 12, wherein the second cam surface comprises an upper second cam surface and a lower second cam surface, and wherein the first cam surface is positioned axially-between the upper second cam surface and the lower second cam surface.

15. The gear of claim 12, wherein a radial distance from a center of the gear to the first cam surface decreases proceeding in a first circumferential direction, and wherein a radial distance from the center of the gear to the second cam surface decreases proceeding in a second, opposing circumferential direction.

16. The gear of claim 12, wherein the first cam surface and the second cam surface are circumferentially-overlapping.

17. A method for making-up or breaking-out a tubular connection, comprising:

opening a door of a tong to expose a slot formed in a gear of the tong, the slot being aligned with a gap in a first portion of a cage plate assembly and a slot defined in the body of the tong, the cage plate assembly comprising a second portion that moves along with the door and when the door is pivoted open and at least one of three jaws fits in the gap of the first portion of the cage plate assembly;

introducing a tubular member laterally into the slot while the door is open;

closing the door;

rotating the gear relative to the cage plate assembly, wherein rotating the gear causes at least three jaws to engage at least three sets of cam surfaces via respective first and second cam surfaces at each of the sets of cam surfaces that are positioned at different axial elevations with respect to a central longitudinal axis through a center of the gear, respectively, defined on an inner surface of the gear, so as to move the at least three jaws radially-inward and into contact with the tubular member, wherein at least one of the three jaws is coupled to the door and initially aligned with the slot; and rotating the tubular member using the tong after the at least three jaws contact the tubular member.

18. The method of claim 17, wherein rotating the gear comprises rotating the gear in a first direction relative to the cage plate assembly, causing the first cam surface of each of the at least three sets of cam surfaces to slide along a corresponding cam surface of each of the at least three jaws, causing the at least three jaws to grip and rotate the tubular member in a make-up direction.

19. The method of claim 18, further comprising again rotating the gear relative to the cage plate assembly, wherein the gear is rotated in a second direction, opposite to the first direction, causing the second cam surface of each of the at least three sets of cam surfaces to slide along a corresponding cam surface of each of the at least three jaws, causing the at least three jaws to grip and rotate the tubular member in a break-out direction.

* * * * *